US008696168B2

(12) United States Patent
Li et al.

(10) Patent No.: US 8,696,168 B2
(45) Date of Patent: Apr. 15, 2014

(54) ILLUMINATION DEVICE

(75) Inventors: Po-Wei Li, New Taipei (TW); Tsung-Chi Lee, New Taipei (TW); Shih-Chang Hsu, New Taipei (TW); Chin Yin Yu, Yilan County (TW)

(73) Assignees: Lite-On Electronics (Guangzhou) Limited, Guangzhou (CN); Lite-On Technology Corporation, Taipei (TW)

( * ) Notice: Subject to any disclaimer, the term of this patent is extended or adjusted under 35 U.S.C. 154(b) by 169 days.

(21) Appl. No.: 13/447,347

(22) Filed: Apr. 16, 2012

(65) Prior Publication Data

US 2012/0275170 A1 Nov. 1, 2012

(30) Foreign Application Priority Data

Apr. 26, 2011 (CN) ..... 2011 1 0104558

(51) Int. Cl.
*F21V 29/00* (2006.01)

(52) U.S. Cl.
USPC ..... 362/294; 362/249.02; 362/373

(58) Field of Classification Search
USPC ..... 362/249.02, 294, 373
See application file for complete search history.

(56) References Cited

U.S. PATENT DOCUMENTS

| | | | | |
|---|---|---|---|---|
| 8,272,762 | B2 * | 9/2012 | Maxik et al. | 362/249.02 |
| 8,274,241 | B2 * | 9/2012 | Guest et al. | 315/294 |
| 8,525,396 | B2 * | 9/2013 | Shum et al. | 313/46 |
| 2009/0296387 | A1 * | 12/2009 | Reisenauer et al. | 362/235 |
| 2010/0277067 | A1 * | 11/2010 | Maxik et al. | 315/32 |
| 2012/0188775 | A1 * | 7/2012 | Chuang | 362/373 |

* cited by examiner

*Primary Examiner* — Peggy A. Neils
(74) *Attorney, Agent, or Firm* — Li & Cai Intellectual Property (USA) Office

(57) ABSTRACT

An illumination device having enhanced thermal dissipating capacity is provided. The illumination device includes a heat sink, an LED module, a cover, an LED driver, and a lamp base. The LED module is disposed at one end of the heat sink. The cover covers the LED module. The LED driver is in connection with the LED module, and includes a circuit board and at least one electrical contact member disposed on the circuit board. The lamp base is connected to the other end of the heat sink, and comprises an insulating unit, a first electrode, a second electrode and at least one contact port. The contact port is arranged on the lateral interior of the insulating unit, so that the electrical contact member of the LED driver may establish electrical connection with the lamp base.

20 Claims, 8 Drawing Sheets

ILLUMINATION DEVICE

BACKGROUND OF THE INVENTION

1. Field of the Invention

The present invention relates to an illumination device, and more particularly to an illumination device utilizing a plurality of LEDs as light source and having an enclosed driver circuit board electrically connected to the light module for converting power source to power the light module.

2. Description of Related Art

In the trend of energy conservation and greenhouse gas reduction, Light Emitting Diode (LED) has been widely employed to replace traditional lighting devices. The widely popular E27 type LED bulb usually requires a LED driver that converts an AC power source into a suitable DC power source for powering the LED module of the LED light bulb. Conventionally, the LED driver is electrically connected to the electrodes of a lamp base by two wires. Moreover, a plastic component is often disposed between the heat sink and the lamp base for breaking the conducting path (to prevent shorting).

The aforesaid LED bulb requires soldering steps in the manufacturing process, for instance, soldering of conductive wires to the circuit board of the LED driver and soldering of conductive wires to the electrodes of the lamp base. The soldering steps are wasteful, inconvenient, and ineffective, and attribute to additional manufacture cost. In addition, due to the existence of the plastic component, the conventional LED bulb often has a limitation of thermal dissipation capability. For one thing, the waste energy in the form of heat may only be transferred via a single heat-dissipating path, i.e. from the LED module to the heat sink. In the conventional LED bulb, the generated heat from the LED module cannot to be effectively transferred to the lamp base because of the plastic component. Thus, the problem of overheating may occur more frequently.

Therefore, the aforementioned drawback is a critical issue needed to be resolved.

SUMMARY OF THE INVENTION

Embodiments of the present invention provide an illumination device such that the driver circuit board thereof may be mechanically plugged into the lamp base without the need of soldering process. By which, the assembly process of the bulb is greatly simplified.

Embodiments of the present invention also provide an illumination device of which the heat-dissipation capability can be enhanced by disposing an insulating unit with the sleeve member inside the lamp base for the purpose of extending the heat-dissipation path from the heat sink to the lamp base. Therefore, the heat generated from the light module can be dissipated to the lamp base effectively.

The illumination device in accordance with the present invention provides the following benefits: due to the driver is assembled into the lamp base via mechanical style plug-in connection, the driver of the instantly disclosed bulb may be quickly assembled, easily replaced, and requires no soldering steps during the manufacturing process; a sleeve member of the insulating unit made of thermal-conductive insulating materials may be applied in the lamp base so as to extend heat-dissipation path from the heat sink to the lamp base, moreover, a shield member of the insulting unit made of high thermal conductivity materials (such as ceramic) may be applied between the first electrode and the lamp base to create another heat dissipation path from the first electrode to the lamp base by convection dissipation; furthermore, when the illumination is a bulb and the bulb is installed onto a E27-type bulb socket, the waste heat generated by the light module can be dissipated not only by the built-in heat sink but also by the bulb socket. In other words, an alternative extended heat-dissipation path out of the bulb is established by installing the bulb into the bulb socket. Therefore, the waste heat is transferred to air through the bulb socket that is made of metal materials. The bulb in accordance with the present invention utilizes a secondary heat-dissipation path in addition to the primary heat-dissipation path provided by the built-in heat sink. The secondary heat-dissipation path, which thermal conductively connects the heat sink to the lamp base (further connects the lamp base to the bulb socket), greatly extends the heat dissipation path and thus enhances overall thermal dissipating capacity of the bulb.

The foregoing, as well as additional objects, features and advantages of the invention will be more readily apparent from the following detailed description, which proceeds with reference to the accompanying drawings.

DETAILED DESCRIPTION OF PREFERRED EMBODIMENT

Figure 1:
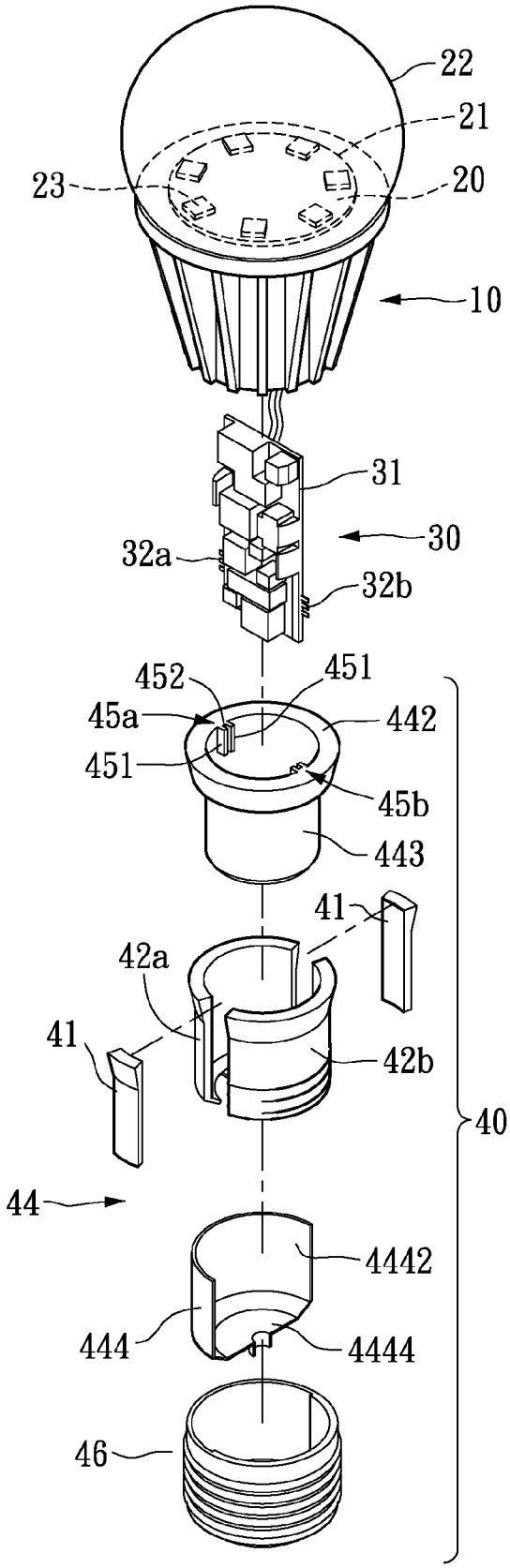
FIG. 1 is an exploded diagram of the bulb according to the present invention.
Figure 2:
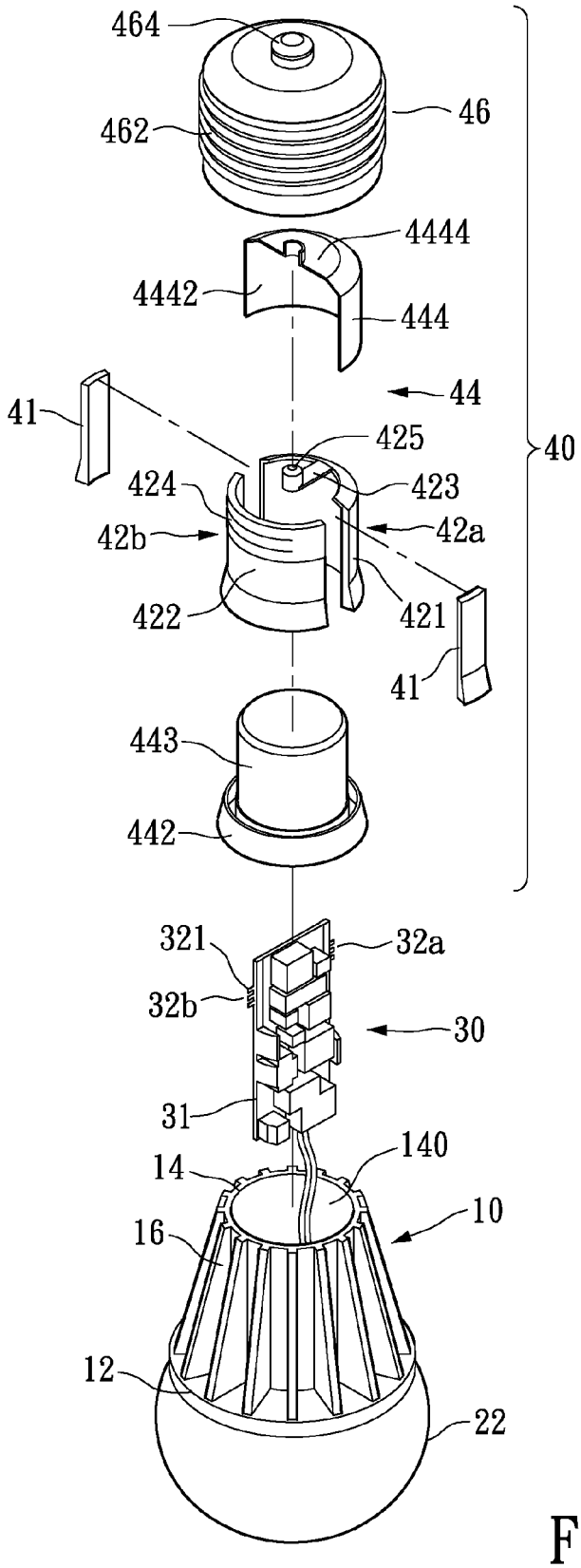
FIG. 2 is an exploded diagram of the bulb according to the present invention viewing from another view angle.

Please refer to FIG. 1 and FIG. 2, which are 3-Dimension exploded diagram of the bulb according to the present invention. The bulb comprises a heat sink 10, a light module 20, a cover 22 that covers the light module 20, a driver 30, and a lamp base 40. For the ease of reference in the following discussion, the cover 22 is defined to be the upper side while the lamp base 40 is defined to be the lower side. Herein, the present invention not restricted to a bulb; it also can be applied to the downlight-type illuminating device.

The heat sink 10 comprises a top plate 12, an accommodation portion 14 and a plurality of fins 16 outwardly extending from the side wall of the accommodation portion 14. The accommodation portion 14 is formed under the top plate 12. The accommodation portion 14 defines an accommodation space 140 inside its hollow body and an opening at the bottom portion thereof.

The light module 20 is disposed on top of the heat sink 10, which also means that the light module 20 is disposed on the top plate 12. The light module 20 may be an LED module including a metal plate 21 and a plurality of LEDs 23 disposed on the metal plate 21. The metal plate 21 may be Metal Core Printed Circuit Board (MCPCB), which incorporates a copper/aluminum base metal material as a means for heat dissipation. The metal core has high thermal conductivity and can provide better heat dissipating capability for conducting generated waste heat to the heat sink 10.

The driver 30, which is in electrical connection with the light module 20, is arranged in the accommodation portion 14 (generally received in the accommodating space 140). The driver 30 includes a circuit board 31 and a pair of electrical contact members 32*a*, 32*b* that are disposed at one end of the circuit board 31. The electrical contact members 32*a*, 32*b* are partially exposed from the bottom of the heat sink 10. In the instant embodiment, each of the electrical contact members 32*a*, 32*b* contains three conducting pins 321 outwardly protruded from the side of the circuit board 31. However, the specific arrangement of the pins 321 may depend on practical and other operational requirements, and should not be limited to the exemplary embodiment provided herein.

Please refer to FIG. 1. The lamp base 40 is connected to the bottom of the heat sink 10. The lamp base 40 includes a first electrode 42*a*, a second electrode 42*b*, an insulating unit 44, and a pair of contact ports 45*a*, 45*b* arranged inside the insulating unit 44. Preferably, the pair of contact ports 45*a*, 45*b* is arranged inside the ring member 442 of the insulating unit 44 corresponding to the pair of the electrical contact member 32*a*, 32*b* of the driver 30. In this diagram, the first electrode 42*a*, the second electrode 42*b* and the insulating unit 44 are separately illustrated.

Figure 3:
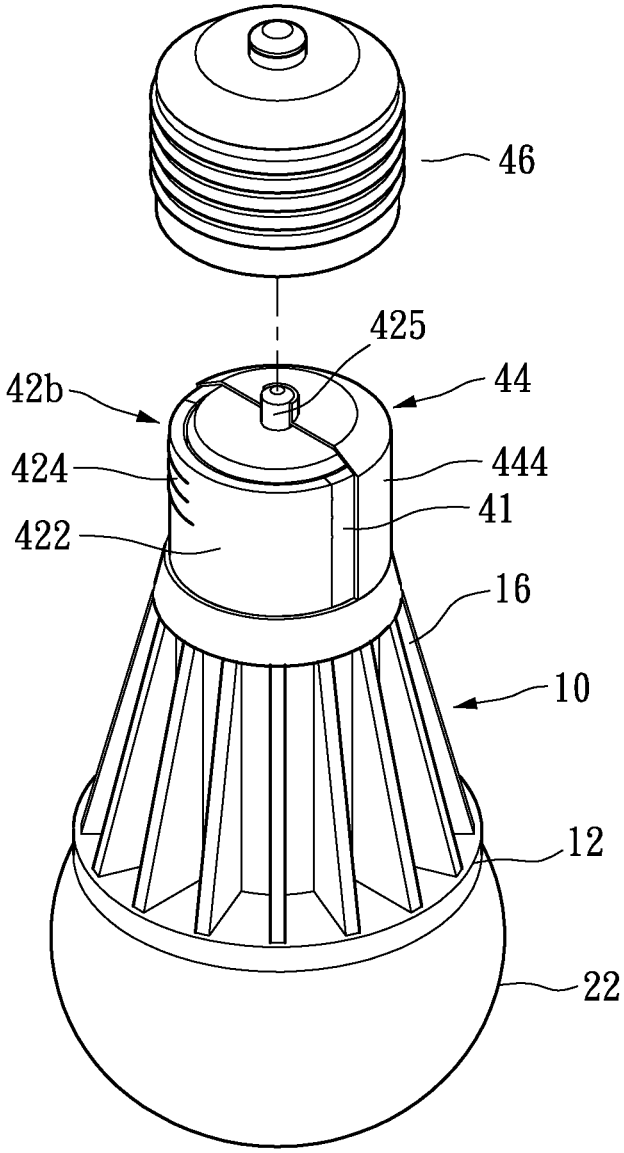
FIG. 3 is a partial assembling diagram of the bulb according to the present invention.

Please refer to FIG. 2 and FIG. 3. The first electrode 42*a* and the second electrode 42*b* are oppositely and separately arranged on the lateral surface of the sleeve member 443. In the instant embodiment, each of the first electrode 42*a* and the second electrode 42*b* has a half-cylindrical main body 421/422. The first electrode 42*a* further includes a conducting arm 423 extending from the bottom portion of the main body 421 and a contact portion 425 located at the end of the arm 423. The rather special shape of the first electrode 42*a* and the second electrode 42*b* may be manufactured by means of metal powder sintering or graphite machining.

The exemplary bulb in accordance with the present invention may further include a pair of isolating members 41 arranged outside the sleeve member 443 of the insulating unit 44 between the first electrode 42*a* and the second electrode 42*b*. The isolating member 41 is made of insulating material, so that the first electrode 42*a* and the second electrode 42*b* can be electrically insulated from each other. In addition, the isolating member 41 may be formed as a fixing member so as to increase the mechanical strength thereof and to more securely retain the first electrode 42*a* and the second electrode 42*b*. Please note that, the isolating member 41 is an optional addition to the instant bulb, and may be omitted as long as the rest of the structural arrangement adequately ensures electrical separation of the first electrode 42*a* and the second electrode 42*b*.

Please refer to FIG. 1~FIG. 3. The insulating unit 44 includes a ring member 442, a sleeve member 443, and a shield member 444 (as shown in FIG. 1 and FIG. 2). The insulating unit 44 is made of insulating material. The ring member 442 and sleeve member 443 may be formed separately or as one integral unit. The shield member 444 includes a hemi-cylinder 4442 and a hemi-circular disc 4444 at the bottom. The first electrode 42*a* and the second electrode 42*b* are disposed outside the sleeve member 443. The ring member 442 abuttingly covers the top portion of the first and the second electrodes 42*a*, 42*b*, and electrically insulates the electrodes 42*a*, 42*b* from the heat sink 10. The shield member 444 covers and shields the lateral portion and part of the bottom of the first electrode 42*a*. The detail description of the configuration will be discussed later. Herein, the shield member 444 may further comprise a circular disc in the bottom of the shield member 4444 so as to become a cup member. With this arrangement, the arm 423 can be fixed on the circular disc of the cup member.

The insulating unit 44 may be made of ceramic powder. The formation of the insulating unit 44 may include the steps of mixing ceramic powder and binder, forming, de-binding, de-waxing, and sintering. Of course, the insulating unit 44 may also be formed by means of injection molding. Due to higher thermal conductivity of the ceramic, the insulating unit 44 may dissipate wasted heat from the heat sink 30 to the lamp base at a higher rate.

One method of assembling of the electrodes 42*a*, 42*b* onto the insulating unit 44 is by forming the insulating unit 44 after the first electrode 42*a* and the second electrode 42*b* are made. For example, referring to FIG. 1, the first electrode 42*a* and the second electrode 42*b* can be fixed in a mold, then perform ceramic or plastic injection into the mold to form the ring member 442, the sleeve member 443, and the shield member 444 into an one-piece integral unit. Upon the completion of the injection molding process, the main body 422 of the second electrode 42*b* is partially exposed from the insulating unit 44.

An alternative assembly method for the first electrode 42*a* and the second electrode 42*b* onto the insulating unit 44 is to form the insulating unit 44 having a ring member 442 and a sleeve member 443 first, and then assemble the first electrode 42*a* and the second electrode 42*b* (and preferably with the isolating members 41) onto the side wall of the sleeve member 443. The shield member 444 is then arranged to cover the outer surface of the first electrode 42*a* so that the hemi-cylinder 4442 shields the outside of the first electrode 42*a* while the hemi-circular disc 4444 shields the arm 423 of the first electrode 42*a*. In this manner, the shield member 444 may prevent direct contact of the first electrode 42*a* and the screw unit 46. Upon the completion of the injection molding process, the main body 422 of the second electrode 42*b* is exposed from the insulating unit 44.

Please refer to FIG. 3, the contact portion 425 of the first electrode 42*a* is exposed from the bottom of the shield member 444 (i.e. bottom of entire lamp), while the main body 422 of the second electrode 42*b* is exposed for establishing direct contact with the screw unit 46.

FIG. 3 shows the configuration of the insulating unit 44, the first electrode 42*a*, and the second electrode 42*b* upon assembly. Preferably, only the second electrode 42*b* is exposed from the insulating unit 44 and arranged at an opposite side of the shield member 444. Moreover, as shown in FIG. 1, the ring member 442 of the insulating unit 44 surroundingly covers the top portion of the first electrode 42*a* and the second electrode 42*b* and extends laterally to the top side of the electrodes 42*a*, 42*b* so as to electrically isolate them from the heat sink 10. The ring member 442 abuts the bottom of the heat sink 10.

Please refer to FIG. 1. In the instant embodiment, the contact ports 45*a* and 45*b* are formed on the insulating unit 44 as an integral one-piece configuration. Each of the contact ports 45*a*/45*b* includes a pair of protruding positioning members 451 that define a slot 452 there-between. Specifically, the positioning members 451 are integral parts of the insulating unit 44 parallelly extending from the inner surface of the ring member 442 while the slot 452 is formed between the positioning members 451. The pair of positioning members 451 may be utilized to retain the position of the electrical contact members 32*a*/32*b* of the driver 30, However, these positioning members 451 are optional and may be omitted, as long as the electrical contact members 32*a*, 32*b* of the driver 30 can be alignedly inserted/plugged into the contact ports 45*a*, 45*b*. For example, each of the contact ports 45*a*, 45*b* may include a slot 452 recessively formed into the inner surface of the insulating unit 44, where the first electrode 42*a* and the second electrode 42*b* being respectively arranged to expose from the slots. The slots 452 may also be used to provide positioning for the circuit board 31. Upon assembly of the lamp base 40, the first electrode 42*a* and the second electrode 42*b* are correspondingly inwardly exposed through the slots 452. When the driver 30 is plugged into the lamp base 40, the electrical contact members 32*a*, 32*b* of the driver are correspondingly inserted into the slots 452 so that the pins 321 can be electrically connected to the first electrode 42*a* and the second electrode 42*b*. In this manner, the electrical contact member 32 of the driver 30 may establish electrical connection with the electrodes of the lamp base 40.

Figure 5:
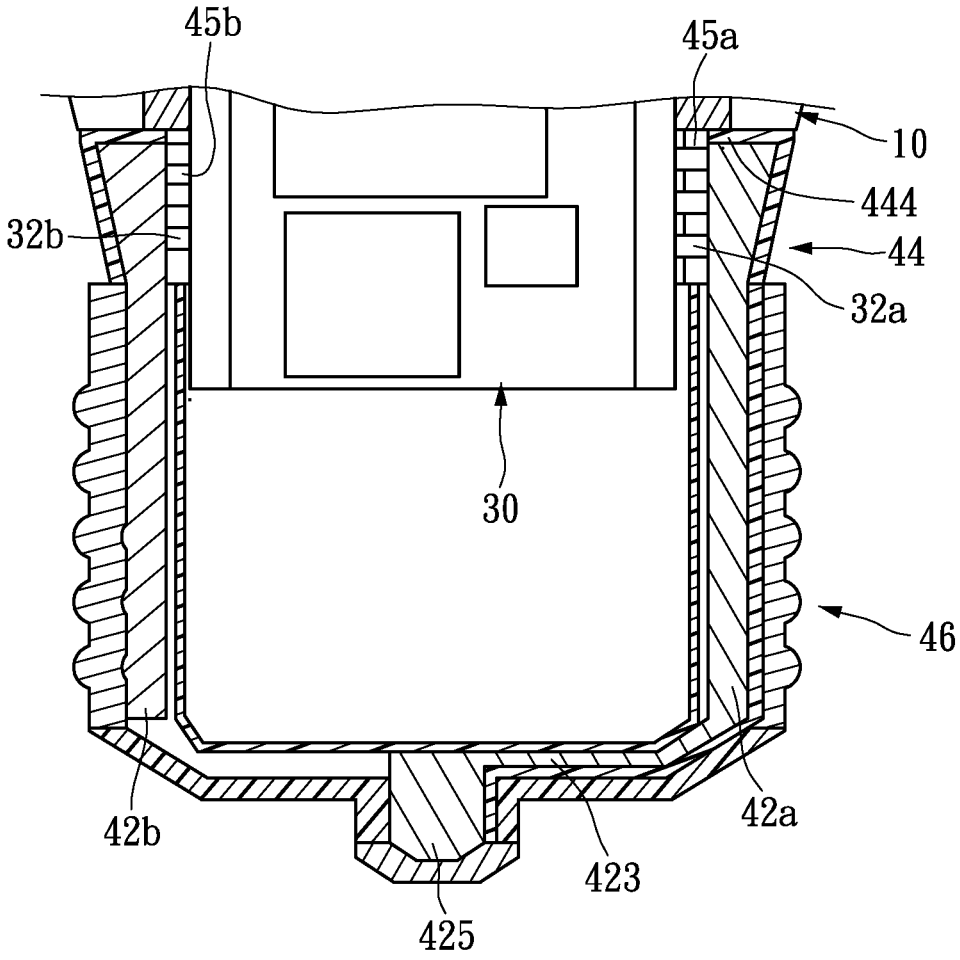
FIG. 5 is a locally enlarged cross-sectional side view of the lamp base according to a first embodiment of present invention.

Please refer to FIG. 5, which shows a locally enlarged cross-sectional diagram around the lamp base of a first embodiment according to the present invention. The first electrode 42*a* and the second electrode 42*b* are respectively inwardly exposed through the contact ports 45*a*, 45*b*. When the electrical contact members 32*a*, 32*b* are inserted into the contact ports 45*a*, 45*b*, the pins 321 (as shown in FIG. 2) of the electrical contact members 32*a*, 32*b* may establish contact with the first electrode 42*a* and the second electrode 42*b*, so as to achieve electrical connection. Thus, the driver 30 may be detachably plugged into the lamp base 40; this arrangement provides the benefits of quick assembly, solder free, and easy replacement of the electrical components. Comparing with conventional designs, the bulb in accordance with the present invention does not require conducting wires to connect the driver 30 to the lamp base 40.

Figure 5A:
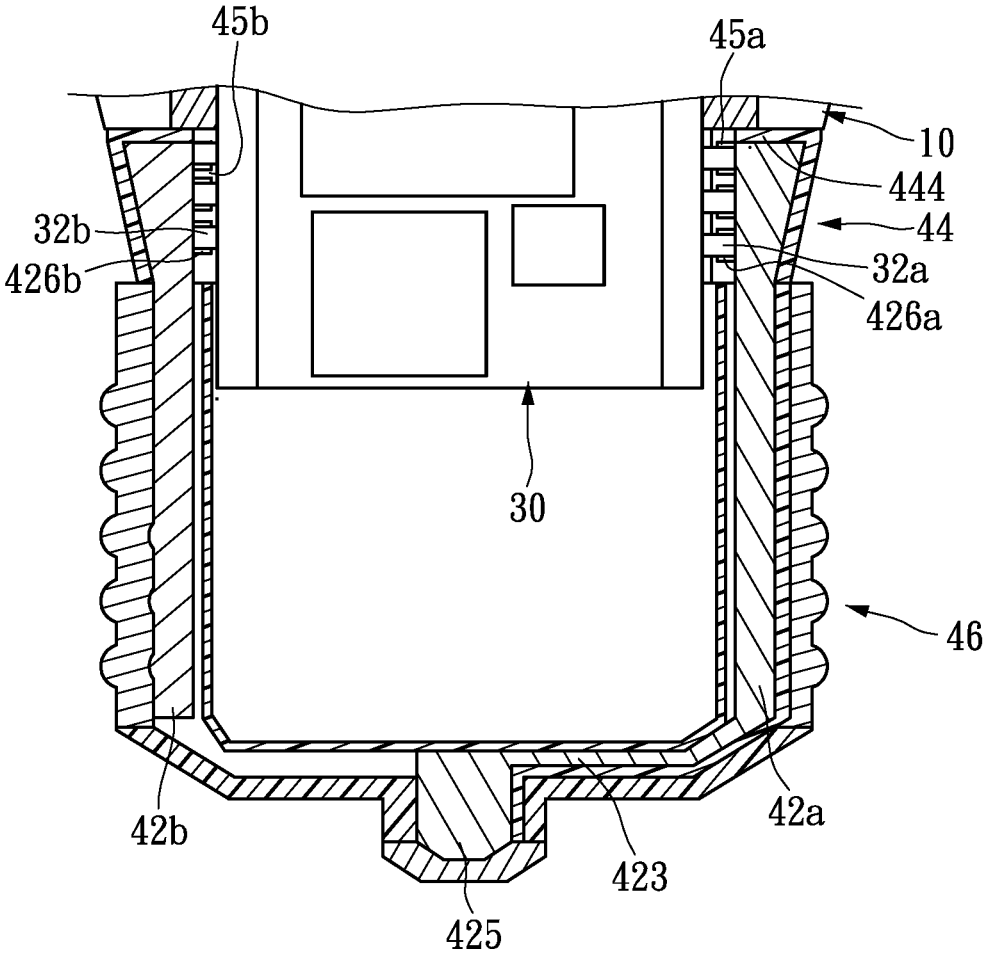
FIG. 5A is a locally enlarged cross-sectional side view of the lamp base according to a second embodiment of present invention.

Please refer to FIG. 5A, which shows a locally enlarged cross sectional diagram of the lamp base 40 according to a second embodiment of the present invention. Comparing with the previous embodiment illustrated in FIG. 5, the each of the first and the second electrodes 42*a* and 42*b* of the instant embodiment may respectively include at least one branch terminal portion (hereinafter referred to as the contact branch) 426*a*/426*b* extending through the contact ports 45*a*, 45*b*. In the instant embodiment, each of the first and the second electrodes 42*a* and 42*b* has three contact branches (426*a*/426*b*). Namely, the contact branches 426*a*, 426*b* extending through the contact port 45*a*, 45*b* may be branched through the inner wall of the position member 451. Thus, the contact branches 426*a*/426*b* may establish electrical connection with the pin of the electrical contact members 32*a*, 32*b* of the driver 30.

The specific number and arrangement of the electrical contact member (32/32*a*/32*b*) and the contact port (45/45*a*/45*b*) need not be limited to the example provided herein. For example, the contact port (45/45*a*/45*b*) may be arranged as a single port having a pair of positioning members 451. In this manner, the contact branches of the first electrode 42*a* may extend to the inner surface of one of the positioning member 451, the contact branches of the second electrode 42*b* may extend to the inner surface of the other one of the positioning member, such that the driver 30, whose circuit board surface is coated with recessive terminals (i.e. the electrical contact member) on the opposite side thereof, can establish electrical contact with the contact branches of the first and second electrodes 42*a*/*b* correspondingly by the plugging of the driver into the lamp base Please refer to FIG. 5B, which shows an overhead cross sectional diagram of the lamp base according to a third embodiment of present invention. This embodiment adapts a single integrated electrical contact member 32 having two pins 321 of different polarities protrudingly arranged on the same side of the driver 30. Correspondingly, the contact port 45 includes a slot 452 and a pair of inwardly extended positioning members 451. The first electrode 42*a* and the second electrode 42*b* are separately exposed from the contact port 45. Herein, by extending the first and second electrodes along the axial direction of the bulb, the extending portions of the first and second electrodes 42*a*, 42*b* may act as the positioning member 451 for positioning the driver 30. The material of the positioning member is not limited to metal; the positioning member 451 may also be made of an insulator extending from the inner wall of insulating unit 44.

Figure 5B:
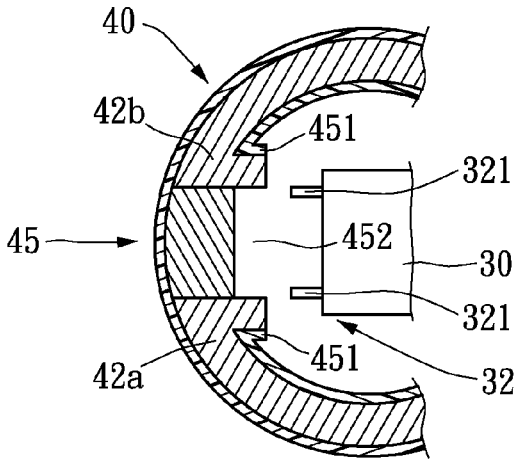
FIG. 5B is an overhead cross sectional view of the lamp base according to a third embodiment of present invention.
Figure 5C:
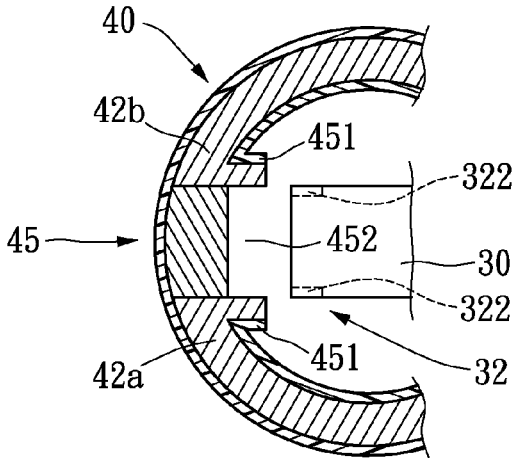
FIG. 5C is an overhead cross sectional view of the lamp base according to a fourth embodiment of present invention.

Please refer to FIG. 5C, which shows an overhead cross sectional diagram of the lamp base of the bulb in accordance with a fourth embodiment of the present invention. Like the previous embodiment, the instant embodiment adapts one integrated electrical contact member 32 that includes two recessive terminals 322 arranged facing toward the same direction (i.e., toward the contact port 45) and a corresponding contact port 45 configured to engage the recessive terminals 322. Specifically, instead of using a pair of protruding pins 321, the instant embodiment adapts a pair of recessive terminal 322 (known as "golden fingers") disposed on the opposite sides of the driver 30 and arranged toward the contact port 45. The contact port 45 includes a slot 452 and a pair of inwardly extending positioning members 451. The first electrode 42*a* and the second electrode 42*b* are separately exposed through the contact port 45.

Figure 5D:
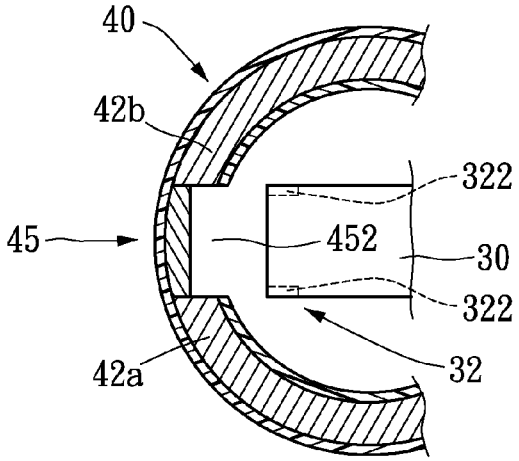
FIG. 5D is an overhead cross sectional view of the lamp base according to a fifth embodiment of present invention.

Please refer to FIG. 5D, which shows an overhead cross sectional diagram of the lamp base 40 of the bulb according to a fifth embodiment of the present invention. Similar to the previous example, the instant embodiment utilizes one integrated electrical contact member 32, which includes two recessive terminals 322 (the "golden finger") and one correspondingly configured contact port 45. However, in the instant embodiment, the contact port 45 only has one slot 452 without the inwardly extending positioning member 451. The first electrode 42*a* and the second electrode 42*b* are separately exposed through the contact port 45. As in the previous embodiment, the pair of recessive terminals 322 are disposed on the opposite sides of the driver 30 and arranged toward the contact port 45. Herein, by reducing the thickness of the isolating member (which is disposed between the first and second electrodes 42*a*, 42*b*), the first and second electrodes 42*a*, 42*b* may be acted as retaining member to retain the driver 30.

Please note that, FIG. 5B-FIG. 5D are only exemplary illustrations for the electrical contact member 32 and the contact port 45. In some embodiments, the driver 30 may be vertically inserted from the upper side of the lamp base 40, another side of the driver may abuttingly contact with the inner surface of the lamp base 40, thus securing structural retention therein.

Figure 4:
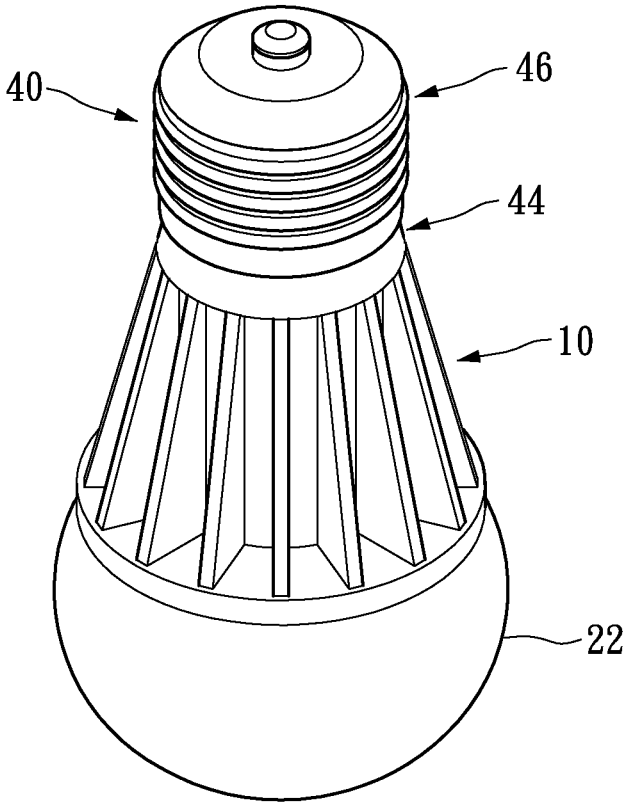
FIG. 4 shows a fully assembling diagram of the bulb according to the present invention.

Next, please refer to FIG. 2 in cooperation with FIGS. 3-5. The bulb may further include a screw unit 46. The screw unit 46 includes a thread element 462 and an electric pole 464. The thread element 462 contacts with the main body 422 of the second electrode 42*b*. The main body 422 may establish contact with the thread element 46 through a plurality of protruding elements 424. The electric pole 464 may establish contact with the first electrode 42*a*. Specifically, the contact portion 425 disposed at the end of the arm 423 may extend to the bottom of the screw unit 46, so that the contact portion 425 can connect the electric pole 464 of the screw unit 46 for electrical conduction. During fabrication, the insulating unit 44 can be directly formed in the screw unit 46. Please refer to FIG. 4 for an illustration of a bulb according to the present invention upon the completion of assembly.

In some embodiments, the screw unit 46 may be omitted. Instead, outer surface of the insulating unit 44 may be provided with a thread pattern that matches an E27 type LED bulb socket. For example, the shield member 444 of the insulating unit 44 and part of the second electrode 42*b* exposed from the insulating unit 44 may be formed with threads, so that the lamp base may be directly screwed into a E27 type bulb socket. In this manner, a metal thread is no longer required.

Figure 6:
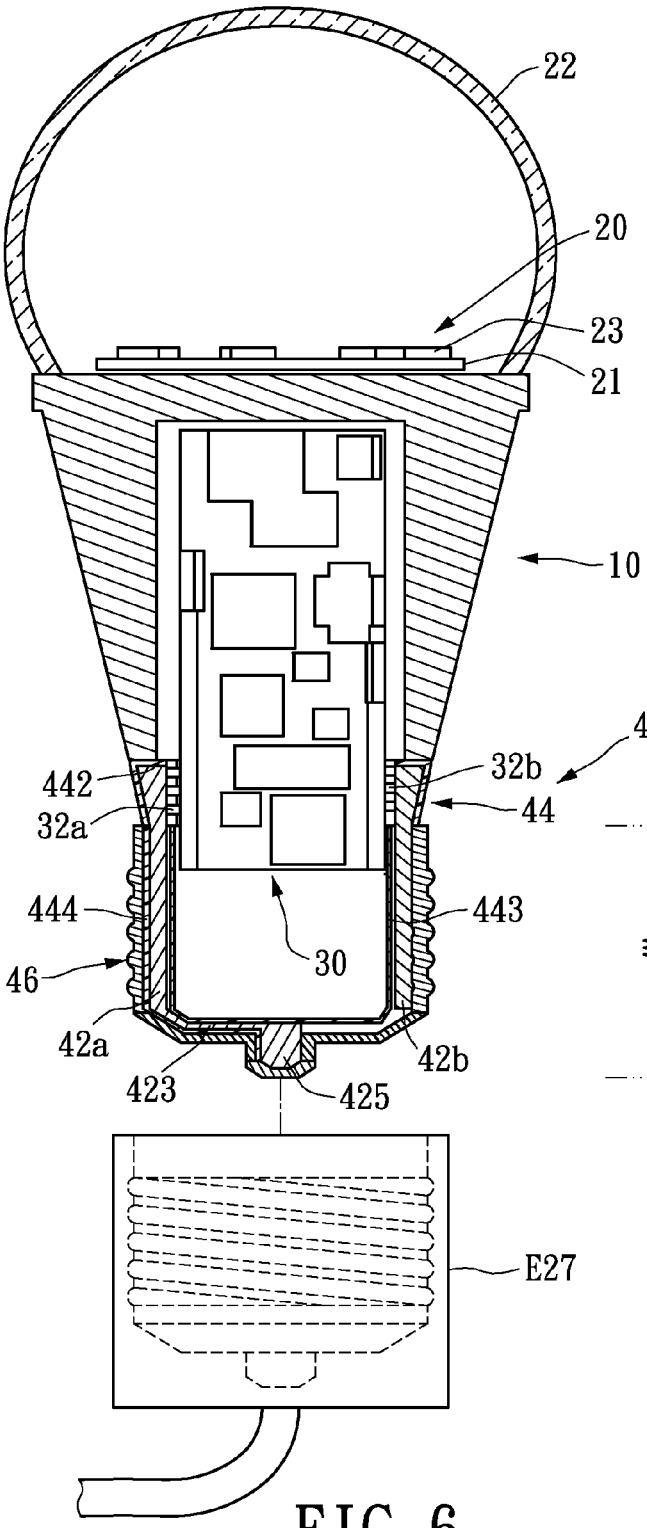
FIG. 6 is a cross sectional diagram of the bulb according to the present invention.
Figure 6A:
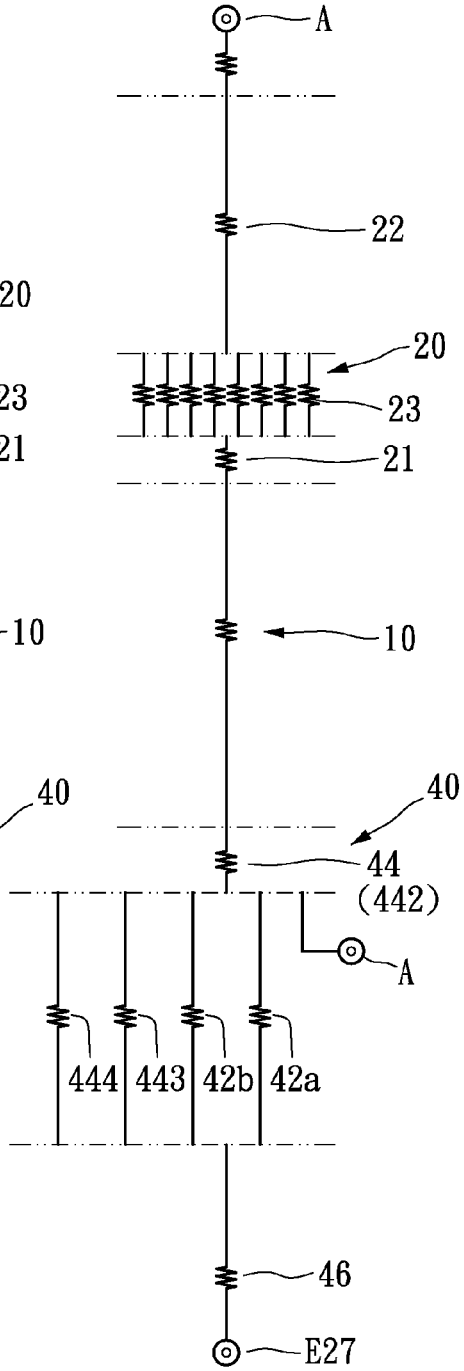
FIG. 6A is a heat dissipation path diagram of the bulb according to the present invention.

Please refer to FIG. 6 and FIG. 6A, which shows a cross sectional diagram of the bulb according to the present invention and a heat dissipation path diagram of the bulb according to the present invention, respectively. In FIG. 6A, the wavy signs represent heat resistance, which is inversely proportional to thermal conductivity. As shown in the diagrams, wasted heat generated by the light module 20 may be transferred upward from the cover 22 to the ambient surrounding (air A), and the wasted heat may be conducted from the metal plate 21 to the heat sink 10. In this manner, the wasted heat may be quickly dissipated through the lamp base (which is in thermal contact with the heat sink 10, ring member 442, the sleeve member 443, electrodes 42*a/b*, shield member 444, screw unit 46, and E27 socket). Therefore, an additional heat dissipation path is established from the bulb to through the E27 type bulb socket, and subsequently to the outside (ambient surrounding). Moreover, the E27 type bulb socket might also be made of ceramic material so as to further improve the heat dissipation rate. Additionally, the shield member 444 of the insulating unit 44 may also contact the screw unit 46, so as to further extend the heat dissipating path. Similarly, the first electrode 42*a* and the second electrode 42*b* can be made of metal having high thermal-conductivity, so that wasted heat might be quickly transferred from the first electrode 42*a* and the second electrode 42*b* to the screw unit 46.

Furthermore, the wasted heat may be transferred from the ring member 442, sleeve member 443, second electrode 42*b*, screw unit 46 and then to the E27 socket so that the heat may be quickly dissipated from the outer surface of the E27 type bulb socket to the ambient surrounding (air A), as shown on the right side of the lamp base in FIG. 6. Besides, the shield member 444 of the lamp base 40 may also be made of high thermally-conductive material, so that the heat dissipating path may be arranged from the ring member 442 to the sleeve member 443, first electrode 42*a*, shield member 444, screw unit 46 and then to the E27 socket, so that the waste heat may be transferred from fins to the E27 socket (shown in left side of lamp base, FIG. 6). Therefore, the additional heat dissipating path provided by the present invention may favorably increase the heat dissipation capacity.

In Summary, the illumination device of the present invention enjoys the following benefits: because the driver is assembled into the lamp base via mechanical style plug-in connection, the driver of the instantly disclosed bulb may be quickly assembled, easily replaced, and requires no soldering steps during the assembly process. Moreover, the bulb in accordance with the present invention utilizes a secondary heat-dissipation path in addition to the primary heat-dissipation path provided by the built-in heat sink. The secondary heat-dissipation path, which thermal conduction connects the heat sink to the bulb socket, greatly increases surface area for heat-dissipation and thus enhances overall thermal dissipating capacity of the bulb.

While certain exemplary embodiments have been described and shown in the accompanying drawings, it is to be understood that such embodiments are merely illustrative of and not restrictive on the broad invention, and that this invention is not be limited to the specific constructions and arrangements shown and described, since various other modifications may occur to those ordinarily skilled in the art.

What is claimed is:

1. An illumination device, comprising:

a heat sink having two ends;

a light module disposed at one end of the heat sink;

a cover covering the light module;

a driver received in the heat sink and in connection with the light module for driving the light module, the driver having a circuit board and at least one electrical contact member disposed on the circuit board; and a lamp base connected to the other end of the heat sink, comprising an insulating unit having a ring member, a sleeve member, and a shield member, the ring member being disposed on the sleeve member;

a first electrode and a second electrode separately disposed on an outer surface of the sleeve member, the ring member contacting with the other end of the heat sink and isolating the heat sink from the first and second electrodes, the shield member covering an outer surface of the first electrode; and at least one contact port arranged on an inner surface of the insulating unit;

wherein the contact port enables part of the first electrode and the second electrode to expose therefrom so that the electrical contact member of the driver is allowed to detachably connect to the lamp base.

2. The illumination device as claim 1, wherein the heat sink further comprises an accommodation portion for receiving the driver and a plurality of fins outward extended from the accommodation portion for dissipating heat generated by the light module and the driver.

3. The illumination device as claim 1, further comprising:

a pair of isolating members disposed between the first electrode and the second electrode for isolating from each other, the pair of isolating members is fixed at the outer surface of the sleeve member.

4. The illumination device as claim 1, further comprising an isolating member disposed between the first electrode and the second electrode and isolating from each other, wherein the first electrode, the second electrode and the isolating member cooperatively form a fixing structure for fixing the driver in the lamp base.

5. The illumination device as claim 1, wherein the first electrode has a first contact branch; the second electrode has a second contact branch; the first contact branch and the second branch are extended through the contact port for contacting with the electrical contact member of the driver.

6. The illumination device as claim 1, wherein insulating unit further comprises a first positioning member and a second positioning member corresponding to the first positioning member, a first contact branch of the first electrode is disposed on an inner surface of the first positioning member, a second branch of the second electrode is disposed on an inner surface of the second positioning member.

7. The illumination device as claim 6, wherein the first positioning member and the second positioning member are disposed on an inner surface of the sleeve member, or on an inner surface of the ring member.

8. The illumination device as claim 1, wherein the electrical contact member comprises two pins having different polarities, the two pins are disposed on the side portion of the circuit board for constructing an electrical connection between the driver and the first and second electrodes, one of the two pins contacts with the first electrode, the other one of the two pins contacts with the second electrode.

9. The illumination device as claim 1, wherein the electrical contact member comprises two recessive terminals, the two recessive terminals are respectively disposed on a top surface and bottom surface of the circuit board for constructing an electrical connection between the driver and the first and second electrodes, one of the two recessive terminals contacts with the first electrode exposed from the contact port, the other one of the two recessive terminals contacts with the second electrode exposed from the contact port.

10. The illumination device as claim 1, wherein two contact ports are formed on the inner surface of the insulating unit, one of the two contact ports exposes the first electrode; and the other one of the two contact ports exposes the second electrode.

11. The illumination device as claim 10, wherein the electrical contact member comprises two pins with different polarities, the two pins are respectively disposed on two side portions of the circuit board corresponding to the two contact ports, one of the two pin contacts with the first electrode exposed from one of the two contact ports, the other one of the two pins contacts with the second electrode exposed from the other one of the two contact ports.

12. The illumination device as claim 10, wherein the electrical contact member comprises two recessive terminals with different polarities, the two recessive terminals are respectively disposed on two opposite surfaces of the circuit board, one of the recessive terminals with positive polarity is contacted with the first electrode exposed from one of the two contact ports, the other one of the recessive terminals with negative polarity is contact with the second electrode exposed form the other one of the two contact ports.

13. The illumination device as claim 1, wherein the insulating unit comprises a pair of first positioning members and a pair of second positioning members, the driver is inserted into the lamp base to construct an electrical connection through the pair of first positioning members and the pair of second positioning members.

14. The illumination device as claim 1, wherein the insulating unit is made of ceramic material.

15. The illumination device as claim 1, wherein each of the first and the second electrodes includes a substantially half-cylindrical main body, wherein the first electrode includes an arm extending from the main body and a contact portion located at one end of the arm, wherein an outer surface of the main body of the second electrode is configured to expose from the insulating unit.

16. The illumination device as claim 15, wherein the shield member of the insulating unit further contains a hemi-cylinder and a hemi-circular disc, the hemi-cylinder shielding outside surface of the first electrode, the hemi-circular disc shielding the arm of the first electrode.

17. The illumination device as claim 15, wherein the illumination device further comprises a screw unit encompassing the insulating unit, the screw unit contacts outside surface of the main body of the second electrode, the contact portion of the arm extending to a bottom portion of the screw unit.

18. The illumination device as claim 1, wherein part of second electrode and shield member are formed with a plurality of thread patterns, so that the lamp base is directly screwed into a lamp socket.

19. An illumination device, comprising:

a heat sink having two ends;

a light module disposed at one end of the heat sink;

a cover covering the light module;

a driver received in the heat sink and in connection with the light module for driving the light module, the driver including a circuit board and at least one electrical contact member disposed on the circuit board; and a lamp base connected to the other end of the heat sink, the lamp base including an insulating unit, wherein at least one contact port is arranged on an inner surface of the insulating unit; and a first electrode and a second electrode separately disposed on an outer surface of the insulating unit and exposed from the contact port;

wherein when the driver is plugged into the contact port of the lamp base, the electrical contact member contacts the first and second electrodes exposed from the contact port so as to establish electrical connection.

20. The illumination device as claim 19, wherein the insulating unit comprises a ring member, a sleeve member and a shield member, the ring member is disposed on the sleeve member for isolating the heat sink from the first and second electrodes, the first and second electrodes are disposed on an outer surface of the sleeve member, and the first electrode is sandwiched between the outer surface of the sleeve member and the shield member.

* * * * *